US006178303B1

(12) United States Patent
Ishii et al.

(10) Patent No.: US 6,178,303 B1
(45) Date of Patent: Jan. 23, 2001

(54) CONTACT DEPTH CONTROLLING ROLLER MECHANISM

(75) Inventors: Hiroshi Ishii, Kashihara; Tetsuro Toyoshima, Soraku-gun; Hiroshi Tatsumi, Shigi-gun; Takashi Sakai, Kitakatsuragi-gun, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/099,349

(22) Filed: Jun. 18, 1998

(30) Foreign Application Priority Data

Jun. 20, 1997 (JP) ..... 9-163885

(51) Int. Cl.[7] ..... G03G 15/08
(52) U.S. Cl. ..... 399/236; 399/279
(58) Field of Search ..... 399/236, 279, 399/286

(56) References Cited

U.S. PATENT DOCUMENTS 4,248,522 * 2/1981 Davis ..... 399/249
5,066,983 * 11/1991 Tonomoto ..... 399/349
5,149,914 * 9/1992 Koga et al. ..... 399/270

FOREIGN PATENT DOCUMENTS 59-223469 12/1984 (JP) .
63-155067 6/1988 (JP) .
5-107902 * 4/1993 (JP) .
7-020697 * 1/1995 (JP) .
7-160108 * 6/1995 (JP) .
8-160750 * 6/1996 (JP) .

* cited by examiner

*Primary Examiner*—Fred L. Braun

(57) ABSTRACT

A developing apparatus includes: a first rotary member; a second rotary member having an elastic surface and adapted to be rotated in contact with the first rotary member. A contact depth controlling roller is kept in rotative free engagement with each end of a shaft of the second rotary member and having an outer circumferential surface abutting against the first rotary member and an inner circumferential surface abutting against the shaft of the second rotary member for keeping a contact depth of the second rotary member abutting against the first rotary member at a predetermined level. A controller is provided so as to rotate the second rotary. This structure, for example, eliminates the need for bearings.

14 Claims, 5 Drawing Sheets

CONTACT DEPTH CONTROLLING ROLLER MECHANISM

CROSS-REFERENCES TO RELATED APPLICATIONS

This application is related to Japanese Patent Application No. HEI 09(1997)-163885 filed on Jun. 20, 1997 whose priority is claimed under 35 USC §119, the disclosure of which is incorporated herein by reference in its entirety.

BACKGROUND OF THE INVENTION

1. Field of the Invention

The present invention relates to a developing apparatus for use for example in electrophotographic machines or electrostatic copying machines. More particularly, the invention relates to a developing apparatus including a developer roller having a conductive elastic surface. The developer roller is adapted to develop an electrostatic latent image on a photoreceptor drum by supplying a developer to the surface of the photoreceptor drum from the developer roller with the developer roller being rotated in contact with the photoreceptor drum.

2. Description of the Related Arts

Conventionally, developing apparatuses which employ a single component developer containing no carrier are simple in construction, so that size reduction, cost reduction and maintenance minimization thereof can readily be achieved. Particularly, developing apparatuses which do not employ a magnetic developer but a nonmagnetic single component toner and hence require no magnetic roller can readily be introduced for commercial use as compact and less expensive developing apparatuses which ensure formation of clear images.

The developing apparatuses employing such a nonmagnetic single component toner are classified into two broad categories: a noncontact type developing apparatuses in which the image development is achieved by applying an alternating electric field between a photoreceptor drum and a developer roller spaced a predetermined distance from the photoreceptor drum to cause the toner to fly back and forth between the photoreceptor drum and the developer roller; and contact type developing apparatuses in which the image development is achieved by bringing a conductive elastic developer roller into contact with a photoreceptor drum.

The noncontact type developing apparatuses require a complicated power supply system capable of withstanding a higher voltage for applying thereto an AC-superposed DC developing bias. On the other hand, the contact type developing apparatuses simply require an DC power supply for applying thereto an DC developing bias and, therefore, are advantageous in that the power supply system is simplified without a requirement for a higher breakdown voltage.

The contact type developing apparatuses are advantageous in many aspects as described above. However, the contact pressure and nip width for keeping the developer roller in contact with the photoreceptor drum greatly influence the quality of an image to be formed.

Japanese Unexamined Patent Publication No. SHO 59(1984)-223469, for example, proposes a contact type developing apparatus capable of keeping the contact pressure and the nip width constant. The contact type developing apparatus includes a pressing member for biasing a conductive elastic developer roller against the surface of a photoreceptor drum and a tracking roll for controlling a biasing pressure to a predetermined level. Further, Japanese Unexamined Patent Publication No. SHO 63(1988)-155067 discloses a developing apparatus which includes a developer roller having an elastic member and a rigid restricting roller fitted to each end of the developer roller and having a smaller diameter than the developer roller.

An explanation will be given to adjustment of the contact depth of the developer roller pressed against the photoreceptor drum by the tracking roll or the restricting roller with reference to FIGS. 6 and 7.

FIG. 6 is a sectional view illustrating a relationship between a photoreceptor drum and a contact depth controlling roller in a conventional contact type developing apparatus as seen from a lateral side. FIG. 7 is a sectional view illustrating the relationship between the photoreceptor drum and the contact depth controlling roller as seen from the front side. In the contact type developing apparatus shown in FIGS. 6 and 7, a developer roller 22 having an elastic surface is kept in contact with the photoreceptor drum 21, and the rigid contact depth controlling roller 25 (tracking roll or restricting roller) which has a diameter smaller by a predetermined amount than the developer roller 22 is rotatably engaged with each end of a shaft 23 of the developer roller 22 via a ball bearing 24. Thus, the contact depth of the developer roller 22 is mechanically kept constant on the basis of a difference in diameter between the developer roller 22 and the contact depth controlling roller 25.

However, the conventional contact type developing apparatus should be provided with a contact depth controlling roller comprised of a ball bearing or a sleeve bearing for accommodating a difference in circumferential velocity between the photoreceptor drum and the developer roller to ensure stable image development while maintaining a predetermined image density.

In addition, the conventional contact type developing apparatus having such a complicated contact depth controlling mechanism suffers fluctuation in the contact nip width and an increase in load torque exerted on a developer roller driving mechanism, which may result from wear-out of sliding contact surfaces and fusing of toner on the bearing and the sliding contact surfaces.

SUMMARY OF THE INVENTION

In view of the foregoing, the present invention is directed to a highly reliable and durable developing apparatus, which includes a simplified contact depth controlling mechanism for accommodating a difference in circumferential velocity between a first rotary member (for example, a photoreceptor drum) and a second rotary member (for example, a developer roller) to keep the contact nip width of the developer roller at a predetermined level during an image developing operation.

In accordance with the present invention, there is provided a developing apparatus which includes: a first rotary member; a second rotary member having an elastic surface and adapted to be rotated in contact with the first rotary member; a contact depth controlling roller kept in rotative free engagement with each end of a shaft of the second rotary member and having an outer circumferential surface abutting against the first rotary member and an inner circumferential surface abutting against the shaft of the second rotary member for keeping a contact depth of the second rotary member abutting against the first rotary member at a predetermined level; and a controller for performing a rotation control so as to rotate the second rotary member with a predetermined circumferential velocity difference with respect to the first rotary member, wherein a circumferential velocity of the outer circumferential surface of the contact depth controlling roller is substantially equal to a circumferential velocity of the first rotary member, and a circumferential velocity of the inner circumferential surface of the contact depth controlling roller is substantially equal to a circumferential velocity of the shaft of the second rotary member.

DETAILED DESCRIPTION OF THE PREFERRED EMBODIMENTS

Figure 1:
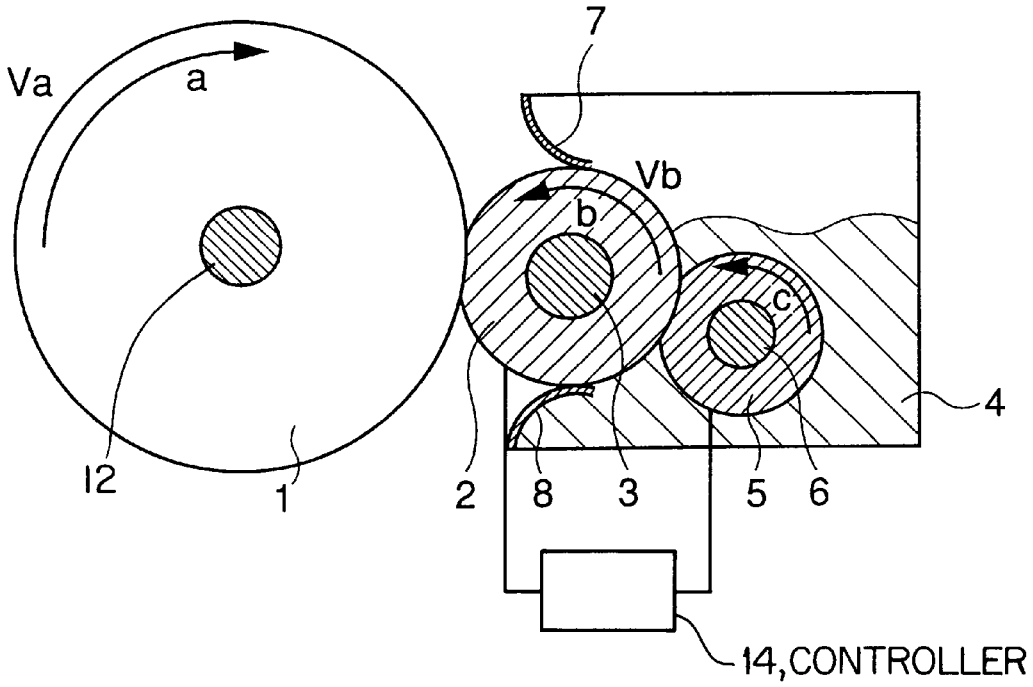
FIG. 1 is a sectional view illustrating the construction of a contact type developing apparatus according to the present invention.

According to a first aspect of the present invention, a developing apparatus includes: a photoreceptor drum for holding an electrostatic latent image formed thereon; a developer roller having a conductive elastic surface and adapted to be rotated in contact with the photoreceptor drum for supplying a developer to the photoreceptor drum; a controller for performing a rotation control so as to rotate the developer roller with a predetermined circumferential velocity difference with respect to the photoreceptor drum; and a contact depth controlling roller kept in rotative free engagement with each end of a shaft of the developer roller and having an outer circumferential surface abutting against the photoreceptor drum and an inner circumferential surface abutting against the shaft of the developer roller for keeping a contact depth of the developer roller abutting against the photoreceptor drum at a predetermined level; wherein the circumferential velocity of the outer circumferential surface of the contact depth controlling roller is substantially equal to the circumferential velocity of the photoreceptor drum, and the circumferential velocity of the inner circumferential surface of the contact depth controlling roller is substantially equal to the circumferential velocity of the shaft of the developer roller.

The controller (14 FIGS. 1, 3, 5, 8, and 9) preferably includes motors for rotating the photoreceptor drum, the developer roller and other rotary members at different constant speeds, motor drivers, driving force transmitting mechanisms, speed sensors, speed controllers, and power sources.

With this arrangement, the circumferential velocity of the outer circumferential surface of the contact depth controlling roller is made substantially equal to the circumferential velocity of the photoreceptor drum, and the circumferential velocity of the inner circumferential surface of the contact depth controlling roller is made substantially equal to the circumferential velocity of the shaft of the developer roller for keeping the contact nip width of the developer roller abutting against the photoreceptor drum at a predetermined level when the developer roller and the photoreceptor roller are rotated at different circumferential velocities. Accordingly, there is no need to provide a bearing for accommodating a difference in circumferential velocity between the photoreceptor drum and the developer roller. Thus, the contact nip width can stably be kept constant over a prolonged period.

According to a second aspect of the present invention, the circumferential velocity ratio of the developer roller to the photoreceptor drum may be set greater than 1 in the developing apparatus according to the first aspect.

With this arrangement, where the circumferential velocity ratio is greater than 1, the outer circumferential surface of the contact depth controlling roller can be brought into direct contact with the surface of the photoreceptor drum. Further, mechanical tolerances for the eccentricity and abutment perpendicularity of the photoreceptor drum can be increased by bringing the outer circumferential surface and inner circumferential surface of the contact depth controlling roller into contact with the surface of the photoreceptor drum and the surface of the shaft of the developer roller, respectively.

According to a third aspect of the present invention, the circumferential velocity of the inner circumferential surface of the contact depth controlling roller may be slightly different from the circumferential velocity of the shaft of the developer roller by a circumferential velocity difference $\Delta Vis$ in the developing apparatus according to the first aspect.

With this arrangement, the inner circumferential surface of the contact depth controlling roller and the shaft of the developer roller are allowed to have the slight circumferential velocity difference, whereby foreign matters caught between the inner circumferential surface of the contact depth controlling roller and the shaft of the developer roller can be forced out for removal thereof. Thus, the service life of the developing apparatus can be extended and an increase in the load torque to be exerted on the driving mechanism can be suppressed without the provision of the bearing.

According to a fourth aspect of the present invention, the circumferential velocity difference $\Delta Vis$ satisfies the following expression:

$$\Delta Vis \leq |(1-\gamma)\cdot(Ds/Db)\cdot Va/10|$$

(wherein Va is the circumferential velocity of the photoreceptor drum; $\gamma$ is the ratio of the circumferential velocity Va of the photoreceptor drum to the circumferential velocity Vb of the developer roller; Db is the diameter of the developer roller; and Ds is the diameter of the shaft of the developer roller) in the developing apparatus according to the third aspect.

With this arrangement, the circumferential velocity difference $\Delta Vis$ between the inner circumferential surface of the contact depth controlling roller and the shaft of the developer roller is set to not greater than 1/10 of that in the conventional apparatus, so that the sliding friction can be reduced to not greater than about 1/10 of that in the conventional apparatus. In addition, foreign matters caught between the inner circumferential surface of the contact depth controlling roller and the shaft of the developer roller can be removed. Further, the service life of the developing apparatus can be extended and the increase in the load torque to be exerted on the driving mechanism can be suppressed without the provision of the bearing.

According to a fifth aspect of the present invention, at least one groove may be formed in the inner circumferential surface of the contact depth controlling roller at an angle with respect to the shaft of the developer roller in the developing apparatus according to the first aspect.

With this arrangement, foreign matters caught between the inner circumferential surface of the contact depth controlling roller and the shaft of the developer roller can be removed more easily.

According to a sixth aspect of the present invention, a developing apparatus includes: a photoreceptor drum for holding an electrostatic latent image formed thereon; a developer roller having a conductive elastic surface and adapted to be rotated in contact with the photoreceptor drum for supplying a developer to the photoreceptor drum; a rotary member adapted to be rotated in contact with the photoreceptor drum; a contact depth controlling roller kept in rotative free engagement with each end of a shaft of the rotary member and having an outer circumferential surface abutting against the photoreceptor drum and an inner circumferential surface abutting against the shaft of the rotary member for keeping a contact depth of the rotary member abutting against the photoreceptor drum at a predetermined level; and a controller for performing a rotation control so as to rotate the developer roller and the rotary member with different predetermined circumferential velocity differences with respect to the photoreceptor drum; wherein the circumferential velocity of the outer circumferential surface of the contact depth controlling roller is substantially equal to the circumferential velocity of the photoreceptor drum, and the circumferential velocity of the inner circumferential surface of the contact depth controlling roller is substantially equal to the circumferential velocity of the shaft of the rotary member.

In this arrangement, the rotary member adapted to be rotated in contact with the photoreceptor drum with the predetermined circumferential velocity difference can be applied, for example, to a cleaning roller for removing toner from the photoreceptor drum after image development, a charging roller for charging the photoreceptor drum, and a transfer roller. This arrangement obviates the need for providing the bearing for accommodating the circumferential velocity difference between the photoreceptor drum and the rotary member. Therefore, the contact nip width (contact depth) between the photoreceptor drum and the rotary member can stably be kept constant over a prolonged period. A contact depth controlling roller having substantially the same construction as described above can be applied to a rotary member which is rotated in contact with the developer roller with a predetermined circumferential velocity difference with respect to the developer roller in the developing apparatus, e.g., a toner supplying roller for supplying toner to the developer roller or a toner removing roller for removing toner from the developer roller after the image development.

According to a seventh aspect of the present invention, a developing apparatus includes: a photoreceptor drum for holding an electrostatic latent image formed thereon; a developer roller having a conductive elastic surface and adapted to be rotated in contact with the photoreceptor drum for supplying a developer to the photoreceptor drum; a flange fitted around each end of a shaft of the photoreceptor drum and having a smaller diameter than the photoreceptor drum; a contact depth controlling roller kept in rotative free engagement with each end of a shaft of the developer roller and having an outer circumferential surface abutting against the flange and an inner circumferential surface abutting against the shaft of the developer roller for keeping a contact depth of the developer roller abutting against the photoreceptor drum at a predetermined level; and a controller for performing a rotation control so as to rotate the developer roller with a predetermined circumferential velocity difference with respect to the photoreceptor drum; wherein the circumferential velocity ratio of the developer roller to the photoreceptor drum is smaller than 1.

With this arrangement, even if the circumferential velocity ratio is smaller than 1, the circumferential velocity of the outer circumferential surface of the contact depth controlling roller is made substantially equal to the circumferential velocity of the flange, and the circumferential velocity of the inner circumferential surface of the contact depth controlling roller is made substantially equal to the circumferential velocity of the shaft of the developer roller by fitting the smaller diameter flange around each end of the shaft of the photoreceptor drum. Therefore, there is no need to provide the bearing for accommodating a difference in circumferential velocity between the photoreceptor drum and the developer roller, and the contact nip width can stably be kept constant over a prolonged period.

The present invention will hereinafter be described by way of embodiments thereof with reference to the attached drawings. It should be understood that the invention is not limited to these embodiments.

FIG. 1 is a sectional view illustrating the construction of a contact type developing apparatus according to the present invention. In FIG. 1, a photoreceptor drum 1 has a diameter Da of 55 mm. The photoreceptor drum 1 is negatively charged at a surface potential of −550V via a conductive base, and rotated at a circumferential velocity Va of 20 mm/sec in the direction of an arrow a. The photoreceptor drum has a shaft 12.

A developer roller 2 has a diameter Db of 27 mm, and has a conductive elastic surface of a conductive urethane rubber containing a conductive material such as carbon black and having a volume resistivity of about $10^7$ Ω·cm and a JIS-A hardness of 60 to 70. The developer roller 2 has a stainless shaft 3 having a diameter Ds of 10 mm. The developer roller 2 is rotated at a circumferential velocity Vb of 260 mm/sec in the direction of an arrow b, and a development bias voltage $E_1$ of −450V is applied to the developer roller 2 via the shaft 3.

A supply roller 5 has a diameter of 20 mm. The supply roller 5 is made of a conductive urethane foam having a volume resistivity of about $10^5$ Ω·cm, a cell density of about 3/mm and an Asca F hardness of 30, and serves for stirring of a toner 4 of a nonmagnetic single component developer and for toner removal after image development. The supply roller 5 has a stainless shaft 6; The supply roller 5 is rotated in contact with the developer roller 2 with a contact depth of 0.5 mm at a circumferential velocity Vc of 150 mm/sec. A supply bias voltage $E_2$ of −550V is applied to the supply roller 5 via the stainless shaft 6.

A reference numeral 7 denotes a resilient blade made of phosphor bronze and having a thickness of 0.1 mm. A blade bias voltage $E_3$ of −550V is applied to the resilient blade 7. After the nonmagnetic single component toner 4 is preliminarily negatively charged and supplied onto the surface of the developer roller 2 by the supply roller 5, the resilient blade 7 restricts the toner adhesion amount to about 0.6 to 0.8 mg/cm$^3$ and the toner charge to about −10 $\mu$C/g for contact reversal development.

A shield plate 8 is comprised of a 0.1-mm thick Mylar film and serves for prevention of scattering of the toner 4. As required, the shield plate 8 may be comprised of a conductive aluminized film. In such a case, the shield plate 8 may be set at a potential equivalent to the potential of the developer roller 2 or a relatively high potential on the order of not lower than about −50V, and brought into contact with the conductive elastic surface of the developer roller 2 for removal of the charge of the toner 4.

Though not shown in FIG. 1, the developing apparatus includes rotary members such as a cleaning roller for removing the toner from the photoreceptor drum 1 after the image development, a toner removing roller for removing the toner from the developer roller 2 after the image development, a charging roller for charging the photoreceptor drum 1, and a transfer roller. Further, the developing apparatus includes a contact depth controlling roller for keeping the contact depth of the developer roller 2 or any of the aforesaid rotary members abutting against the photoreceptor drum 1 at a predetermined level.

The developing apparatus still further includes a controller 14 comprising motors for rotating the photoreceptor drum, a developing roller and the rotary members at different predetermined speeds, for example with motor drivers, driving force transmitting mechanisms, speed sensors, speed controllers and power sources.

Figure 2:
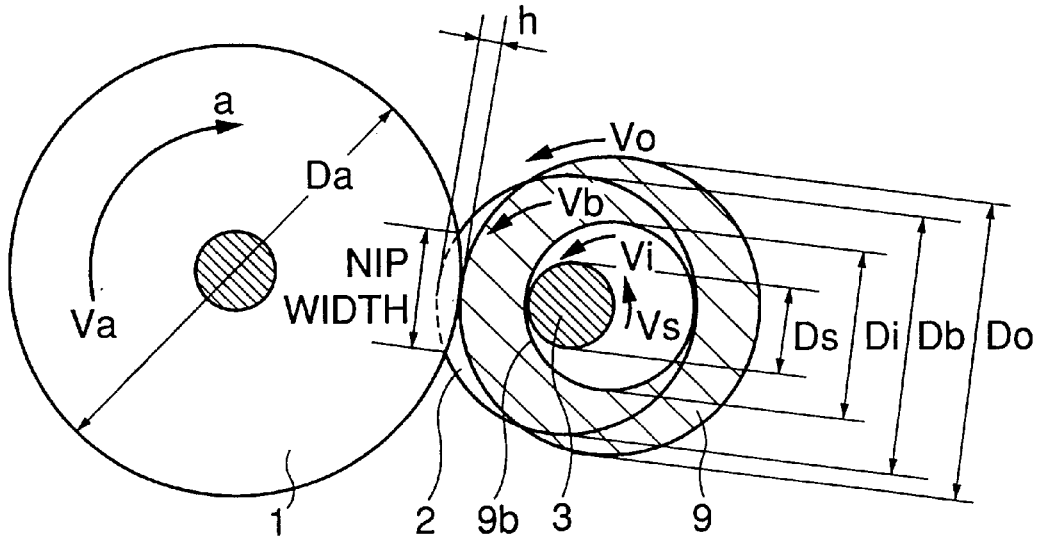
FIG. 2 is a sectional view illustrating a relationship between a photoreceptor drum and a contact depth controlling roller according to a first mode of the present invention, as seen from a lateral side.
Figure 3:
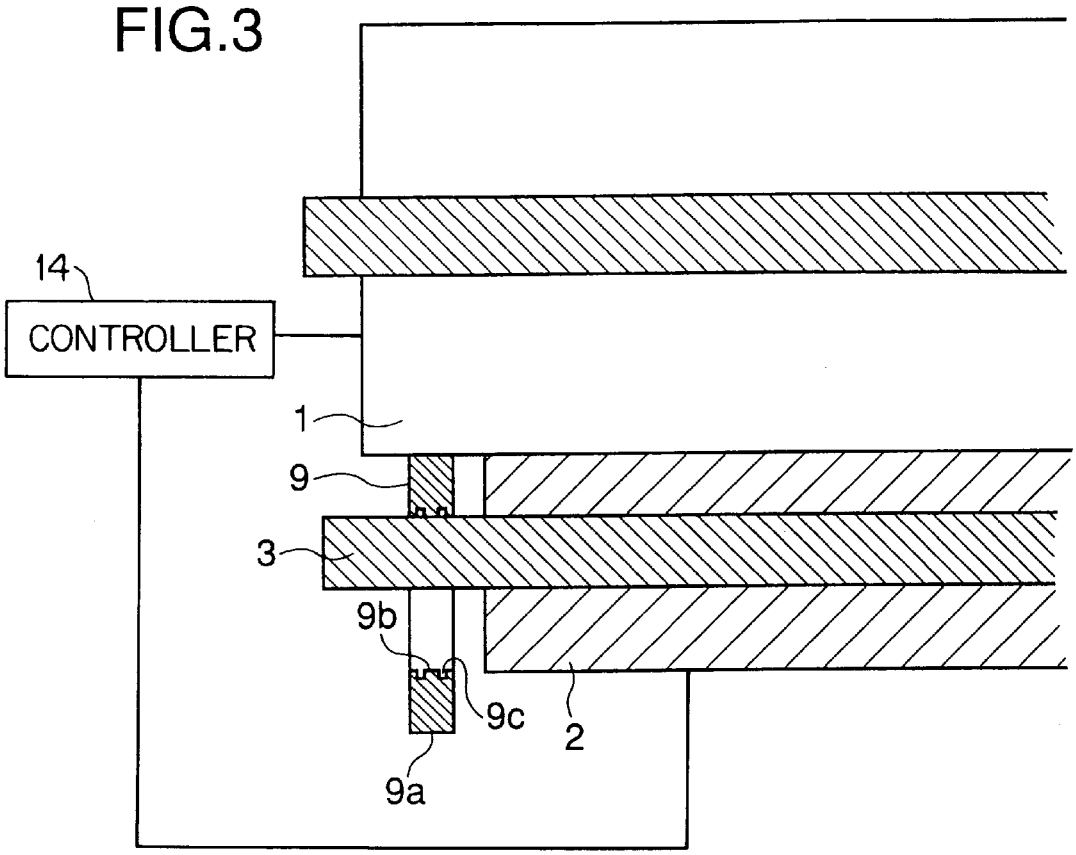
FIG. 3 is a sectional view illustrating the relationship between the photoreceptor drum and the contact depth controlling roller as seen from the front side in FIG. 2.

FIG. 2 is a sectional view illustrating a relationship between the photoreceptor drum and the contact depth controlling roller according to a first mode of the present invention, as seen from a lateral side. FIG. 3 is a sectional view illustrating the relationship between the photoreceptor drum and the contact depth controlling roller as seen from the front side in FIG. 2.

There will be described a developing apparatus according to a first embodiment of the present invention. In FIGS. 2 and 3, a reference numeral 9 denotes the contact depth controlling roller. The contact depth controlling roller 9 is kept in free engagement with each end of the shaft 3 of the developer roller 2. The contact depth controlling roller 9 is a rigid component which has an outer circumferential surface 9*a* abutting against an edge portion of the surface of the photoreceptor drum 1 and an inner circumferential surface 9*b* abutting against the surface of the shaft 3. The contact depth controlling roller 9 restricts the contact depth of the developer roller 2 abutting against the photoreceptor drum 1. The contact depth controlling roller 9 has an outer diameter Do (mm) and an inner diameter Di (mm) which satisfy the following expressions:

$$Do \approx (Db-Ds-2h)/\{1-\gamma(Ds/Db)\} \quad (1)$$

$$Di = Do-(Db-Ds-2h) \quad (2)$$

$$\gamma \geqq Db/(Db-2h) \quad (3)$$

wherein h is the contact depth (mm) of the developer roller 2 abutting against the photoreceptor drum 1, and $\gamma$ is a circumferential velocity ratio Vb/Va.

The outer diameter Do and inner diameter Di of the contact depth controlling roller 9 are determined by the expressions (1), (2) and (3). The circumferential velocity Va of the photoreceptor drum 1 is nearly equal to the outer circumferential velocity Vo of the contact depth controlling roller 9 (Va≈Vo), and the outer circumferential velocity Vs of the shaft 3 is nearly equal to the inner circumferential velocity Vi of the contact depth controlling roller 9 (Vs≈Vi). More specifically, the provision of the contact depth controlling roller 9 having the predetermined outer diameter Do and inner diameter Di allows the circumferential velocity ratio of the developer roller 2 to the photoreceptor drum 1 to be kept at a predetermined level, and prevents the outer and inner circumferential surfaces of the contact depth controlling roller 9 from sliding with respect to the photoreceptor drum 1 and the developer roller 2. Thus, the photoreceptor drum 1 and the developer roller 2 can be rotated at different constant speeds in contact with each other with a predetermined contact depth.

The contact depth controlling roller 9 has, for example, an outer diameter Do of 31.8 mm and an inner diameter Di of 15.3 mm to keep a contact depth h of 0.25 mm, and is made of a polyacetal resin which is rigid and exhibits a negligible distortion and deformation.

In accordance with the first embodiment, the circumferential velocities of the outer and inner circumferential surfaces of the contact depth controlling roller 9 are set equivalent to the circumferential velocities of the photoreceptor drum 1 and the shaft 3 of the developer roller 2, respectively, to keep the contact nip width of the developer roller 2 abutting against the photoreceptor drum 1 at a predetermined level when the photoreceptor drum 1 and the developer roller 2 are rotated with a predetermined circumferential velocity difference. Therefore, there is no need to provide a bearing for accommodating the difference in circumferential velocity between the photoreceptor drum 1 and the developing roller 2. Further, the contact nip width can stably be kept constant over a prolonged period.

A developing apparatus according to a second embodiment of the present invention will next be described. The developing apparatus of the second embodiment is substantially the same as the developing apparatus of the first embodiment, except that the diameter Da of the photoreceptor drum 1 is 65 mm, the diameter Db of the developer roller 2 is 34 mm, the circumferential velocity Va of the photoreceptor drum 1 is 200 mm/sec, and the circumferential velocity ratio $\gamma$ of the developer roller 2 to the photoreceptor drum 1 is 1.5. The other conditions are the same as in the first embodiment.

The contact depth controlling roller 9 includes a 5 mm thick polyacetal resin layer, and has an outer diameter Do of 42 mm and an inner diameter Di of 18.5 mm to keep the contact depth h at 0.25 mm.

In accordance with the second embodiment, where the circumferential velocity ratio $\gamma$ is greater than 1, the outer circumferential surface of the contact depth controlling roller 9 can be brought into direct contact with the surface of the photoreceptor drum 1. Further, the inner circumferential surface of the contact depth controlling roller 9 is brought into direct contact with the surface of the shaft 3 of the developer roller 2, so that the tolerances for the eccentricity and abutment perpendicularity of the photoreceptor drum 1 can be increased.

A developing apparatus according to a third embodiment of the present invention will next be described. The contact surfaces of the contact depth controlling roller 9 and the shaft 3 of the developer roller 2 are allowed to have a slight circumferential velocity difference $\Delta$Vis, so that frictional forces exerted between the contact depth controlling roller 9 and the photoreceptor drum 1 and between the contact depth controlling roller 9 and the shaft 3 of the developer roller 2 are properly controlled for removal of foreign matters such as toner caught between the contact surfaces of the contact depth controlling roller 9 and the shaft 3. Therefore, the photoreceptor drum 1 is rotated in contact with the outer circumferential surface of the contact depth controlling roller 9 at a constant speed without any slide, while the shaft 3 of the developer roller 2 is rotated in contact with the inner circumferential surface of the contact depth controlling roller 9 with sliding friction caused therebetween for accommodating the slight circumferential velocity difference Δvis.

When the circumferential velocity difference ΔVis between the shaft 3 of the developer roller 2 and the inner circumferential surface of the contact depth controlling roller 9 satisfies the following expression, a sufficient foreign matter removing effect can be ensured and the sliding friction can be reduced to not greater than 1/10 to 1/100.

$$|(1-\gamma)\cdot(Ds/Db)\cdot Va/100| \leqq \Delta Vis \leqq |(1-\gamma)\cdot(Ds/Db)\cdot Va/10)|$$

This allows the developing apparatus to have a longer service life and a lower load torque without provision of a shaft supporting member such as a bearing.

A developing apparatus according to a fourth embodiment of the present invention will next be described. To enhance the foreign matter removing effect described in the third embodiment, 25 grooves 9*c* each having a width of 0.5 mm and a depth of 0.2 mm are equidistantly formed in the inner circumferential surface of the contact depth controlling roller 9 abutting against the shaft 3 at an angle of 30 degrees with respect to the axis of the shaft 3. With this arrangement, foreign matters are forced toward the center of the developer roller 2 for removal thereof as the contact depth controlling roller 9 is rotated. Therefore, even if foreign matters such as toner are caught between the inner circumferential surface of the contact depth controlling roller 9 and the shaft 3 of the developer roller 2, the foreign matters are expelled through the grooves 9*c* by the rotation of the contact depth controlling roller 9. Thus, the contact depth controlling roller 9 can stably be rotated with the friction coefficient of the inner circumferential surface of the contact depth controlling roller 9 being kept constant during the rotation thereof, thereby improving the reliability of the developing apparatus.

A developing apparatus according to a fifth embodiment will next be described. The contact depth controlling roller according to the present invention is applied to a rotary member which is rotated in contact with the photoreceptor drum with a predetermined circumferential velocity difference with respect to the photoreceptor drum. Examples of specific rotary members include a cleaning roller for removing toner from the photoreceptor drum after image development, a charging roller for charging the photoreceptor drum, and a transfer roller. With this arrangement, there is no need to provide a bearing for accommodating the circumferential velocity difference between the photoreceptor drum and the rotary member as in the first embodiment. Further, the contact nip width (contact depth) of the rotary member abutting against the photoreceptor drum can stably be kept constant over a prolonged period. A contact depth controlling roller having substantially the same construction as described above can be applied to a rotary member which is rotated in contact with the developer roller with a predetermined circumferential velocity difference with respect to the developer roller in the developing apparatus, e.g., a toner supplying roller for supplying toner to the developer roller or a toner removing roller for removing toner from the developer roller after the image development.

Figure 4:
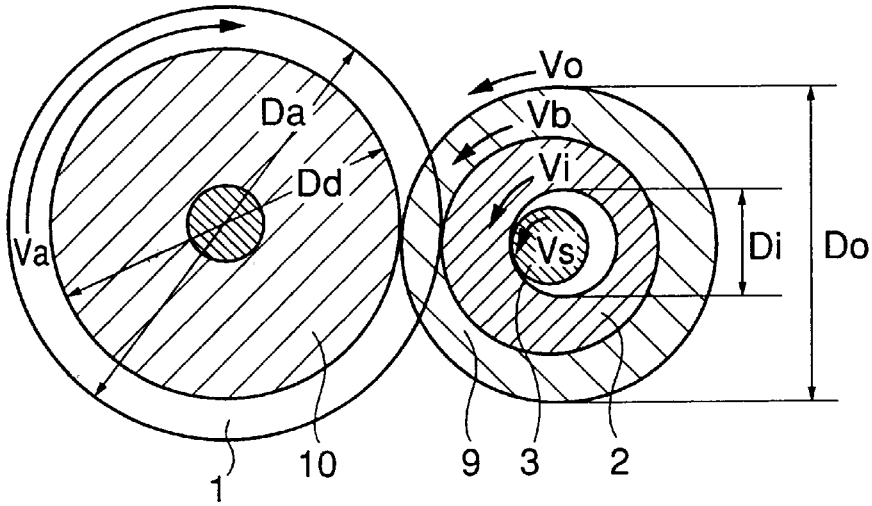
FIG. 4 is a sectional view illustrating a relationship between a photoreceptor drum and a contact depth controlling roller according to a second mode of the present invention, as seen from a lateral side.
Figure 5:
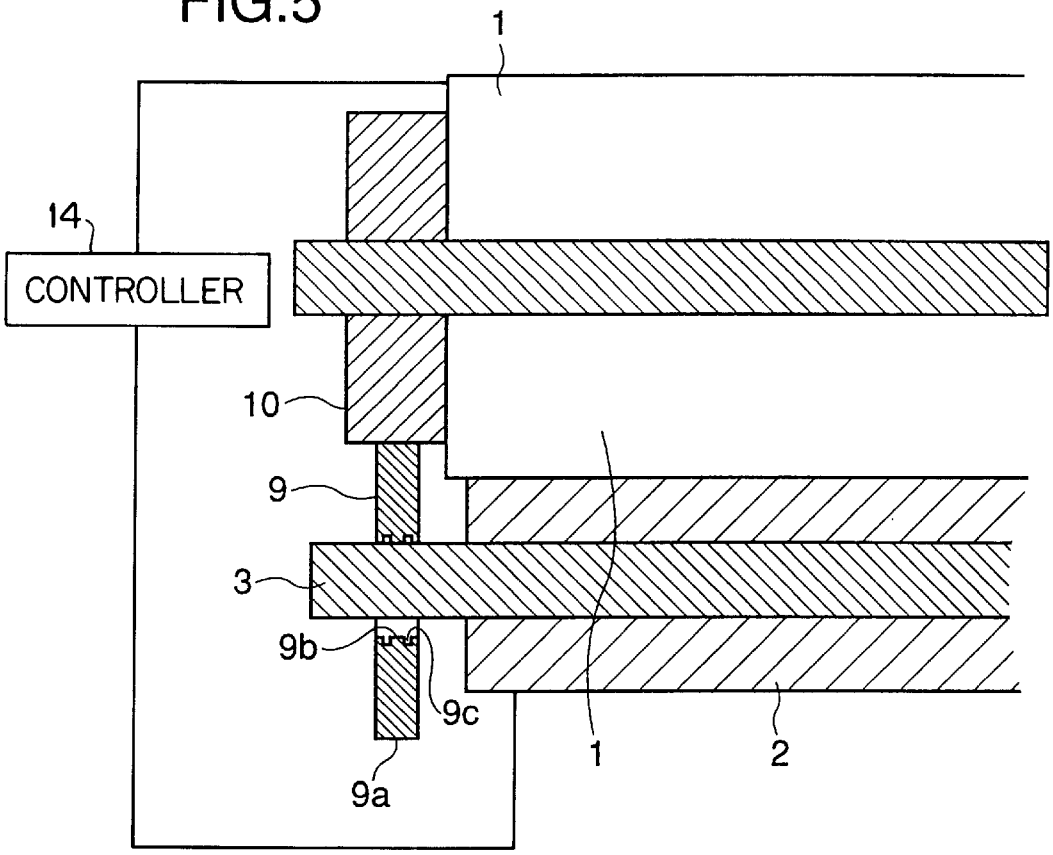
FIG. 5 is a sectional view illustrating the relationship between the photoreceptor drum and the contact depth controlling roller as seen from the front side in FIG. 4.
Figure 6:
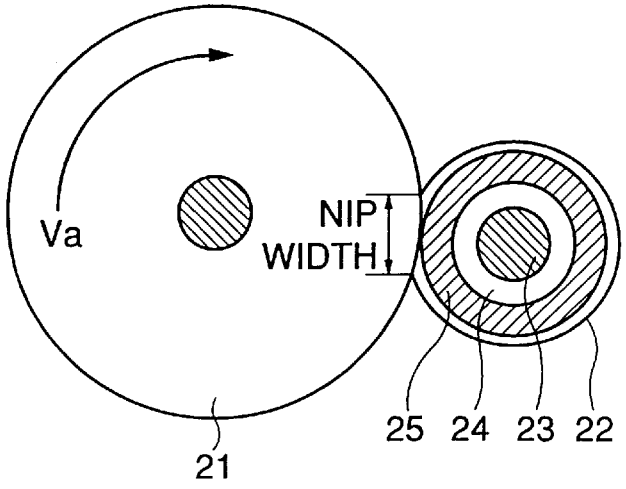
FIG.6 PRIOR ART
FIG. 6 is a sectional view illustrating-a relationship between a photoreceptor drum and a contact depth controlling roller of a conventional contact type developing apparatus as seen from a lateral side.
Figure 7:
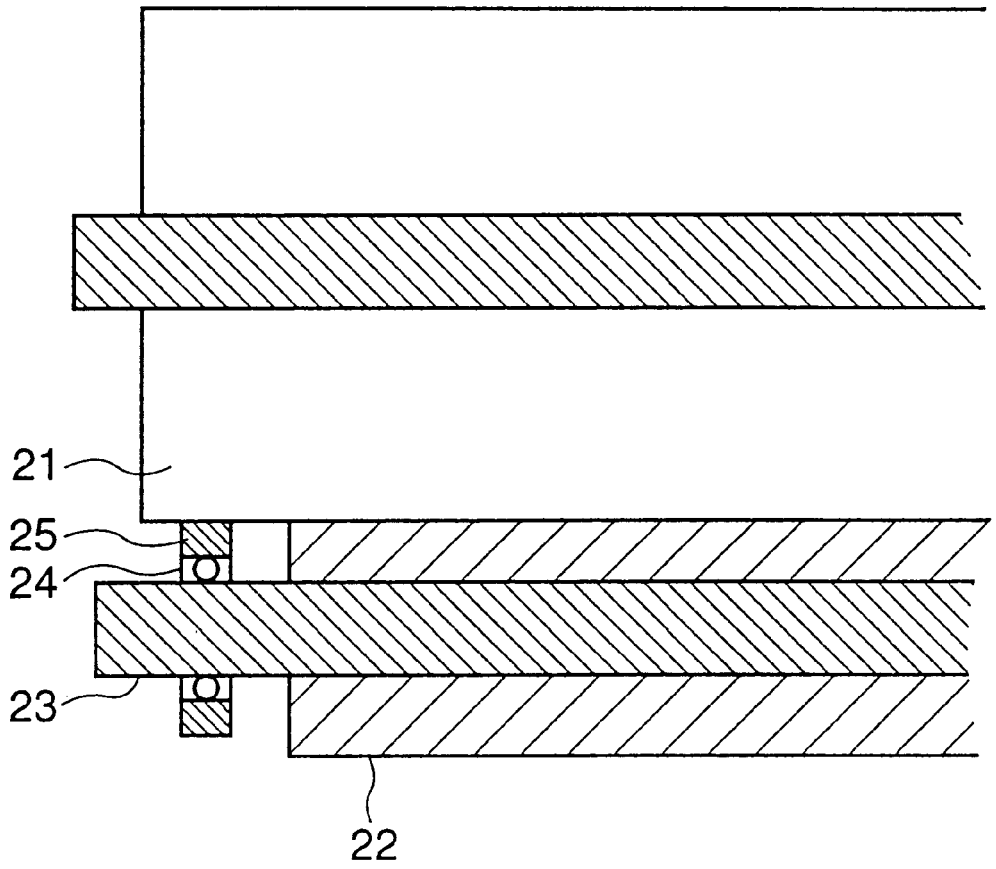
FIG.7 PRIOR ART
FIG. 7 is a sectional view illustrating the relationship between the photoreceptor drum and the contact depth controlling roller as seen from the front side in FIG. 6.

FIG. 4 is a sectional view illustrating a relationship between the photoreceptor drum and the contact depth controlling roller according to a second mode of the present invention, as seen from a lateral side. FIG. 5 is a sectional view illustrating the relationship between the photoreceptor drum and the contact depth controlling roller as seen from the front side in FIG. 4.

A developing apparatus according to a sixth embodiment of the present invention will next be described. A flange 10 having a diameter Dd (Dd<Da) is provided on each end face of the photoreceptor drum 1, and brought into contact with the contact depth controlling roller 9. The contact depth controlling roller 9 has an outer diameter Do (mm) and an inner diameter Di (mm) which satisfy the following expressions:

$$Do \approx (Da-Dd+Db-Ds-2h)/\{1-\gamma\cdot(Ds/Db)\cdot(Da/Dd)\} \quad (4)$$

$$Di = Do-(Da-Dd+Db-Ds-2h) \quad (5)$$

$$Di > Ds \quad (6)$$

wherein h is the contact depth (mm) of the developer roller 2 abutting against the photoreceptor drum 1, and γ is a circumferential velocity ratio Vb/Va. In the developing apparatus according to the sixth embodiment, the circumferential velocity ratio is set at not greater than 1.

The outer diameter Do and inner diameter Di of the contact depth controlling roller 9 are determined by the expressions (4), (5) and (6). The circumferential velocities of the outer and inner circumferential surfaces of the contact depth controlling roller 9 are substantially equal to the circumferential velocities of the flange 10 and the shaft 3 of the developer roller 2, respectively, so that the contact depth of the developer roller 2 abutting against the photoreceptor drum 1 is kept at a predetermined level as in the first and second embodiments.

More specifically, the photoreceptor drum 1 has a diameter Da of 55 mm, and the flange 10 provided on each end face of the photoreceptor drum 1 has a diameter Dd of 45 mm. The developer roller 2 has a diameter Db of 27 mm, and the contact depth controlling roller 9 serving to bring the developer roller 2 into contact with the photoreceptor drum 1 is formed of a polyacetal resin as having an outer diameter Do of 40.1 mm and an inner diameter Di of 13.6 mm.

For removal of foreign matters for example toner caught between the contact surfaces of the contact depth controlling roller 9 and the shaft 3, the contact surfaces may be allowed to have a slight circumferential velocity difference ΔVis, and grooves 9*c* may equidistantly be formed in the inner circumferential surface of the contact depth controlling roller 9 at an angle with respect to the axis of the shaft 3.

Figure 8:
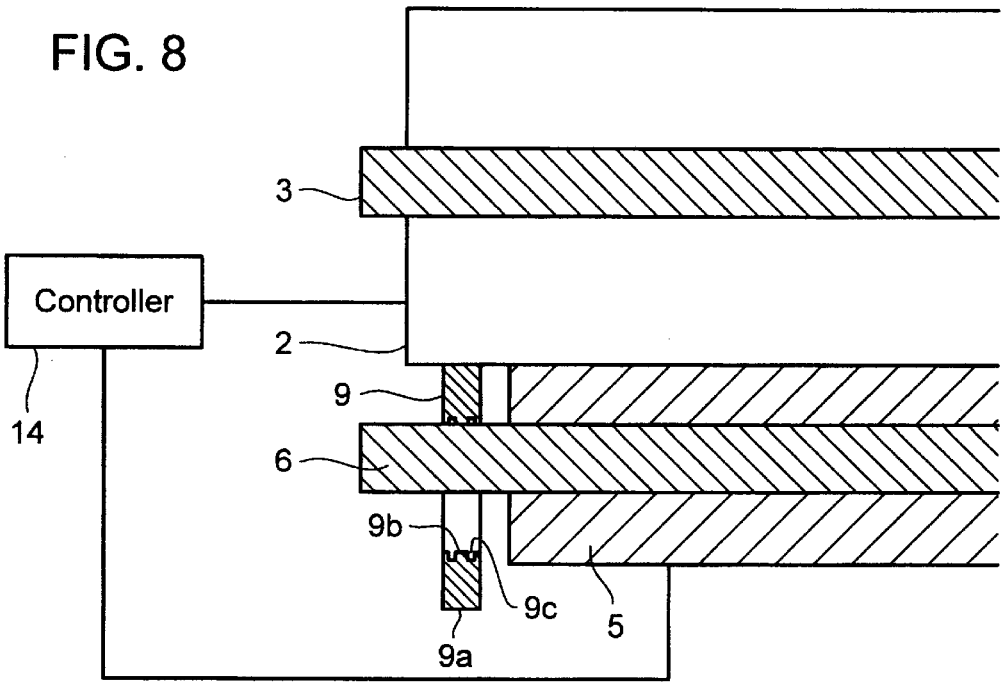
FIG. 8 is a sectional view illustrating the relationship between the developer roller and the supplying roller.
Figure 9:
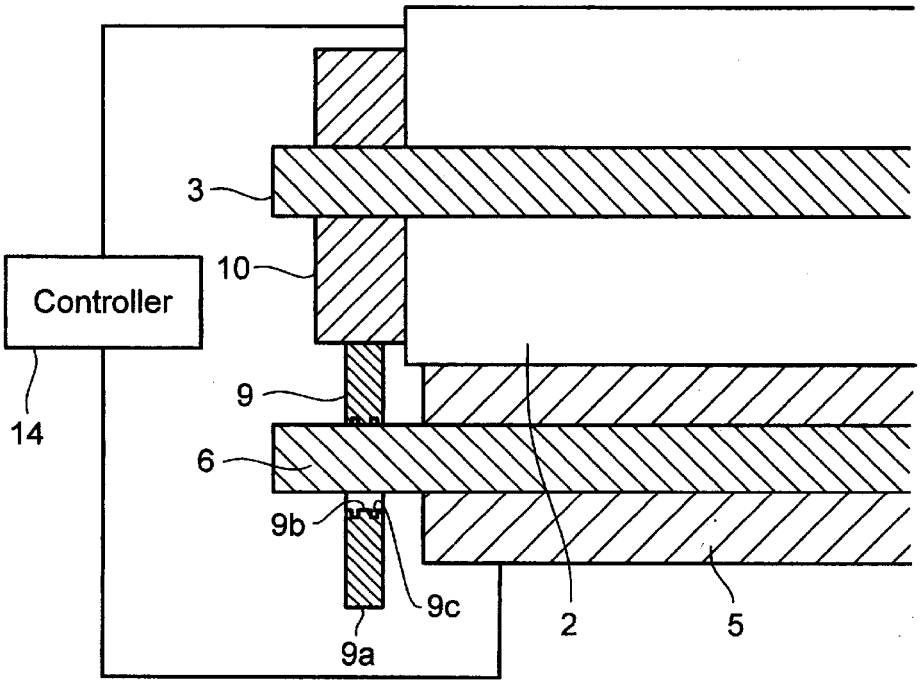
FIG. 9 is a sectional view illustrating the relationship between the developer roller and the supplying roller.

In accordance with this embodiment, the contact nip width of the developer roller can stably be kept constant, whereby images having a sufficient image density and free of fogging can be formed with an excellent gradation and fine line reproducibility. Further, sliding friction and foreign matter adhesion on the contact surfaces of the contact depth controlling roller can be eliminated, so that an image developing operation can stably be performed over a prolonged period. FIGS. 8 and 9 illustrate the embodiments of the developer roller 2, the supply roller 5, and the controlling roller 9.

What is claimed is:

1. A contact depth controlling mechanism comprising:

a first rotary member;

a second rotary member having an elastic surface and adapted to be rotated in contact with the first rotary member;

a contact depth controller roller having an outer circumferential surface to abut against the first rotary member and an inner circumferential surface to be in free engagement with a shaft of the second rotary member, for keeping a contact depth of the second rotary member abutting against the first rotary member at a predetermined level while the contact depth controller roller is in rotative free engagement with an end of the shaft of the second rotary member; and a controller for performing a rotation control so as to rotate the second rotary member with a predetermined circumferential velocity difference with respect to the first rotary member, wherein the contact depth controlling roller is formed to have an outer diameter such that a circumferential velocity of the outer circumferential surface of the contact depth controlling roller is substantially equal to a circumferential velocity of the first rotary member, and an inner diameter such that a circumferential velocity of the inner circumferential surface of the contact depth controlling roller is substantially equal to a circumferential velocity of the shaft of the second rotary member.

2. A contact depth controlling mechanism of claim 1, wherein a circumferential velocity ratio of the second rotary member to the first rotary member is greater than 1.

3. A contact depth controlling mechanism of claim 1, wherein the circumferential velocity of the inner circumferential surface of the contact depth controlling roller is slightly different from the circumferential velocity of the shaft of the second rotary member by a circumferential velocity difference ΔVis.

4. A contact depth controlling mechanism of claim 3, wherein the circumferential velocity difference ΔVis satisfies the following expression:

$$\Delta Vis \leqq |(1-\gamma)\cdot(Ds/Db)\cdot Va/10|$$

(wherein Va is the circumferential velocity of the first rotary member; γ is a ratio of the circumferential velocity Va of the first rotary member to the circumferential velocity Vb of the second rotary member; Db is a diameter of the second rotary member; and Ds is a diameter of the shaft of the second rotary member).

5. A contact depth controlling mechanism of claim 1, wherein the contact depth controlling roller has at least one groove formed in the inner circumferential surface thereof at an angle with respect to the shaft of the second rotary member.

6. A contact depth controlling mechanism of claim 1, wherein the first rotary member comprises a photoreceptor drum for holding an electrostatic latent image formed thereon, and the second rotary member comprises a developing roller having a conductive elastic surface and adapted to be rotated in contact with the photoreceptor drum for supplying a developer to the photoreceptor drum.

7. A contact depth controlling mechanism of claim 1, wherein the first rotary member comprises a developing roller, and the second rotary member comprises a supplying roller having an elastic surface and adapted to be rotated in contact with the developing roller for supplying a developer to the developing roller.

8. A contact depth controlling mechanism comprising:

a first rotary member;

a second rotary member having an elastic surface and adapted to be rotated in contact with the first rotary member;

a flange fitted around an end of a shaft of the first rotary member and having a smaller diameter than the first rotary member;

a contact depth controlling roller having an outer circumferential surface to abut against the flange and an inner circumferential surface to be in free engagement with a shaft of the second rotary member, for keeping a contact depth of the second rotary member abutting against the first rotary member at a predetermined level while the contact depth controller roller is in rotative free engagement with an end of the shaft of the second rotary member; and a controller for performing a rotation control so as to rotate the second rotary member with a predetermined circumferential velocity ratio with respect to the first rotary member, wherein the contact depth controlling roller is formed to have an outer diameter such that a circumferential velocity of the outer circumferential surface of the contact depth controlling roller is substantially equal to a circumferential velocity of the flange, and an inner diameter such that a circumferential velocity of the inner circumferential surface of the contact death controlling roller is substantially equal to a circumferential velocity of the shaft of the second rotary member.

9. A contact depth controlling mechanism of claim 8, wherein a circumferential velocity ratio of the second rotary member to the first rotary member is smaller than 1.

10. A contact depth controlling mechanism of claim 8, wherein the circumferential velocity of the inner circumferential surface of the contact depth controlling roller is slightly different from the circumferential velocity of the shaft of the second rotary member by a circumferential velocity difference ΔVis.

11. A contact depth controlling mechanism of claim 10, wherein the circumferential velocity difference ΔVis satisfies the following expression:

$$\Delta Vis \leqq |(1-\gamma)\cdot(Ds/Db)\cdot Va/10|$$

(wherein Va is the circumferential velocity of the first rotary member; γ is a ratio of the circumferential velocity Va of the first rotary member to the circumferential velocity Vb of the second rotary member; Db is a diameter of the second rotary member; and Ds is a diameter of the shaft of the second rotary member).

12. A contact depth controlling mechanism of claim 8, wherein the contact depth controlling roller has at least one groove formed in the inner circumferential surface thereof at an angle with respect to the shaft of the second rotary member.

13. A contact depth controlling mechanism of claim 8, wherein the first rotary member comprises a photoreceptor drum for holding an electrostatic latent image formed thereon, and the second rotary member comprises a developing roller having a conductive elastic surface and adapted to be rotated in contact with the photoreceptor drum for supplying a developer to the photoreceptor drum.

14. A contact depth controlling mechanism of claim 8, wherein the first rotary member comprises a developing roller, and the second rotary member comprises a supplying roller having an elastic surface and adapted to be rotated in contact with the developing roller for supplying a developer to the developing roller.

* * * * *